US009803434B2

(12) United States Patent
Elliott

(10) Patent No.: US 9,803,434 B2
(45) Date of Patent: Oct. 31, 2017

(54) WELL LIFT FRAME

(71) Applicant: Stingray Offshore Solutions LLC, Houston, TX (US)

(72) Inventor: Matthew S. Elliott, Houston, TX (US)

(73) Assignee: Stingray Offshore Solutions, LLC, Houston, TX (US)

( * ) Notice: Subject to any disclaimer, the term of this patent is extended or adjusted under 35 U.S.C. 154(b) by 386 days.

(21) Appl. No.: 14/456,815

(22) Filed: Aug. 11, 2014

(65) Prior Publication Data

US 2016/0040487 A1 Feb. 11, 2016

(51) Int. Cl.
*E21B 19/06* (2006.01)
*B66C 1/42* (2006.01)

(52) U.S. Cl.
CPC ..... *E21B 19/06* (2013.01); *B66C 1/425* (2013.01)

(58) Field of Classification Search
CPC ..... E21B 19/06; E21B 19/16; E21B 19/164; E21B 19/165; E21B 19/12; E21B 19/18; F16L 1/207
See application file for complete search history.

(56) References Cited

U.S. PATENT DOCUMENTS 3,023,651 A * 3/1962 Wallace ..... E21B 19/164 81/57.18
3,799,009 A * 3/1974 Guier ..... E21B 19/164 81/57.16
4,593,584 A * 6/1986 Neves ..... E21B 19/164 81/57.18
4,647,099 A * 3/1987 Berry ..... E21B 17/16 294/103.1
6,206,096 B1 * 3/2001 Belik ..... E21B 19/168 166/380
7,360,589 B2 4/2008 Moncus et al.
8,590,626 B2 11/2013 Barone et al.
9,453,377 B2 * 9/2016 Mosing ..... E21B 19/165

* cited by examiner

*Primary Examiner* — Kipp Wallace
(74) *Attorney, Agent, or Firm* — Haynes and Boone, LLP

(57) ABSTRACT

A well lift frame, clamp assembly therefor, and method for handling well equipment is disclosed. In an embodiment, the lift frame includes a frame, a vertical slot forming an opening in a side of the frame, and a clamping assembly mounted to the side of the frame near the opening. The clamping assembly may include a linkage assembly arranged so as to travel along an arcuate path between a disengaged position, in which the clamping assembly is substantially clear of the opening, and an engaged position in which the clamping assembly at least substantially covers a horizontal extent of the opening. The linkage assembly may define a four-bar linkage mechanism. The clamping assembly may also include an actuator coupled to the linkage assembly so as to selectively position the linkage assembly, and a shoe carried by the linkage assembly for contacting and clamping equipment within the vertical slot.

18 Claims, 8 Drawing Sheets

WELL LIFT FRAME

TECHNICAL FIELD

The present disclosure relates to well operations, and more specifically to a device and method for manipulating well equipment by an well lift frame.

BACKGROUND

Certain well operations, such as well intervention using coiled tubing injection, require a lift frame to position equipment above the wellhead and structurally support the equipment while well operations are being performed. When well operations are performed offshore, the lift frame may include motion compensating systems to account for heave of the drilling platform or vessel.

With conventional methods of well operations, a tubular string or other equipment is hung from bail points, typically located at the bottom or near the lower end of the lift frame. However, due in part to developing technology and increasing variance of well intervention equipment, for certain operations the string or other equipment is hung through a vertical slot formed in the lift frame itself, typically in a lower section of the lift frame.

Hanging equipment through the lift frame slot requires a safety device that secures the equipment to the lift frame. One common safety device involves a door that may be linearly slid across the lift frame slot to cover it. Such a safety door typically does not contact the intervention string or equipment when shut, thereby potentially allowing the string or equipment to shift within the slot and create large dynamic forces against the door.

It is desirable, therefore, to provide a lift frame having a clamping device that contacts the string or equipment to secure it within the vertical slot for such operations.

BRIEF DESCRIPTION OF THE DRAWINGS

Embodiments are described in detail hereinafter with reference to the accompanying figures, in which.

DETAILED DESCRIPTION

Figure 1:
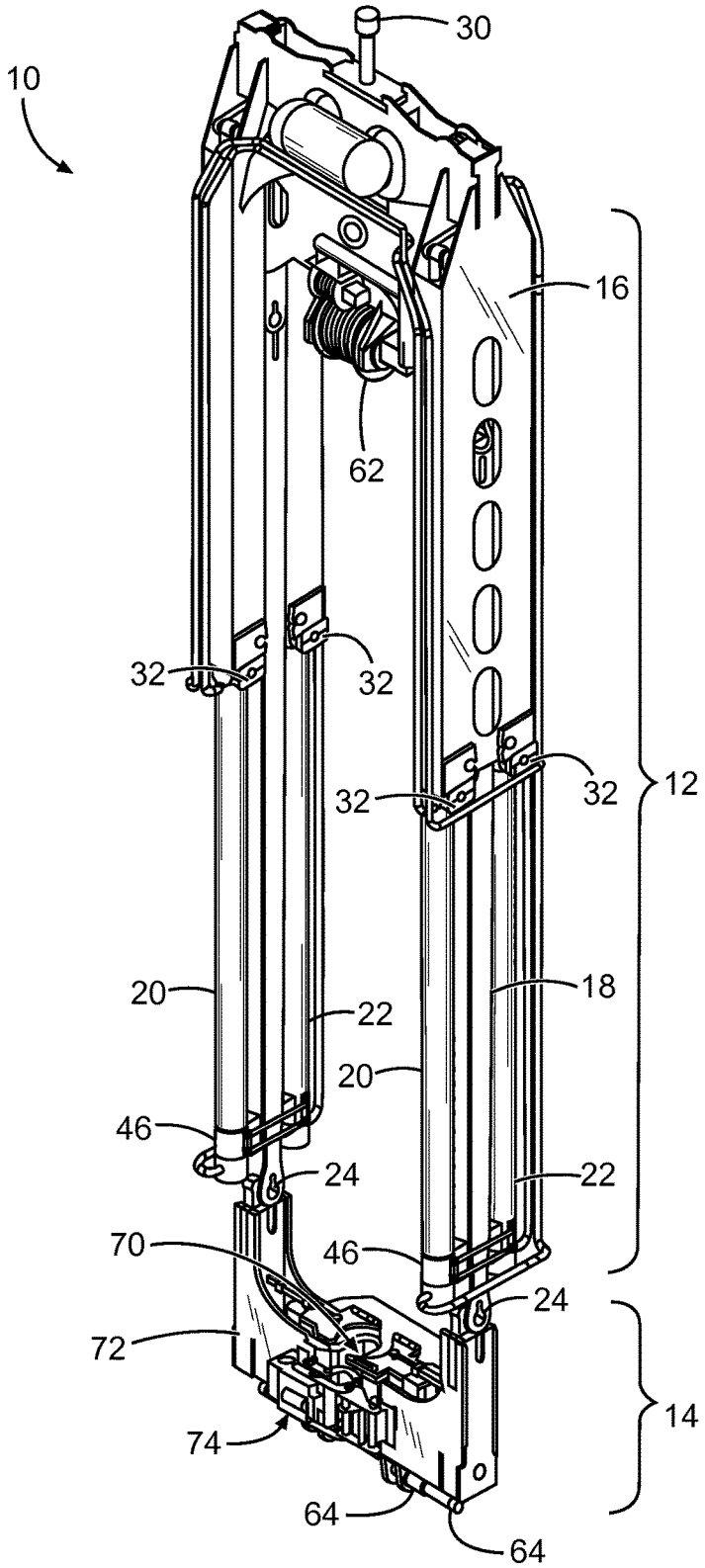
FIG. 1 is a perspective view of a well lift frame according to an embodiment, showing an upper section for suspension by a rig and a motion-compensated lower section having a vertical slot and a clamping assembly for safely suspending a string or other equipment within the vertical slot.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," "front," "back," "left," "right," "top," "bottom," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. In addition, figures are not necessarily drawn to scale but are presented for ease of explanation.

Various items of equipment such as pipes, valves, pumps, fasteners, fittings, bearings, etc., may be omitted to simplify the description. However, routineers in the art will realize that such conventional equipment may be employed as appropriate.

Figure 2:
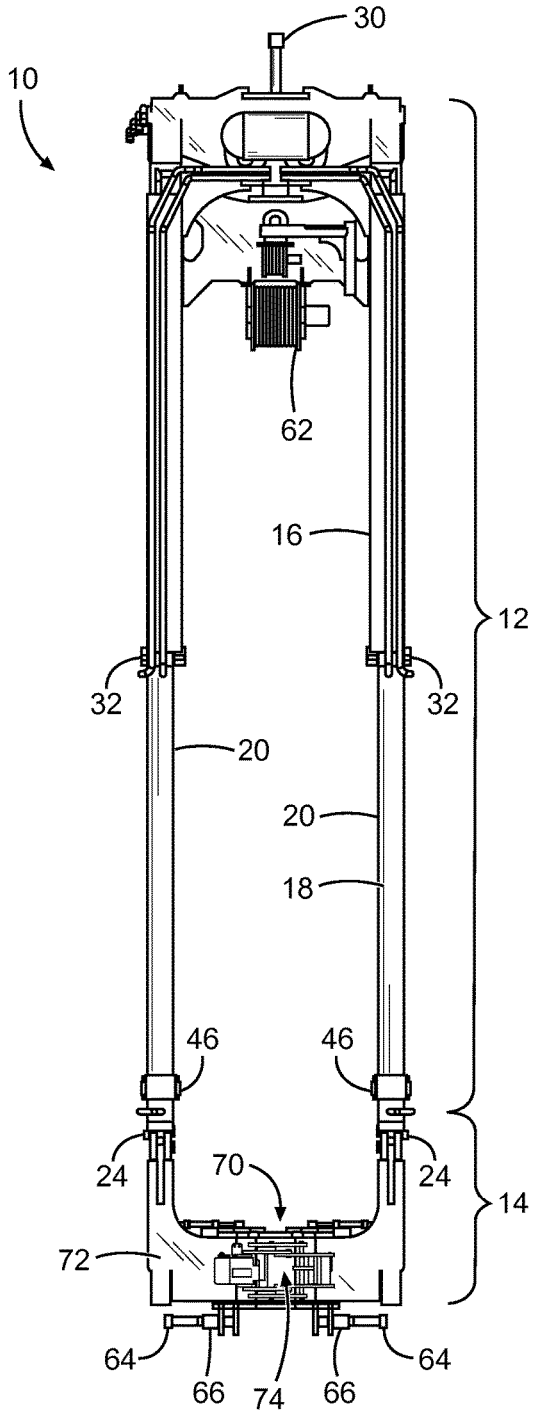
FIG. 2 is an elevation view of the front side of the lift frame of FIG. 1.
Figure 3:
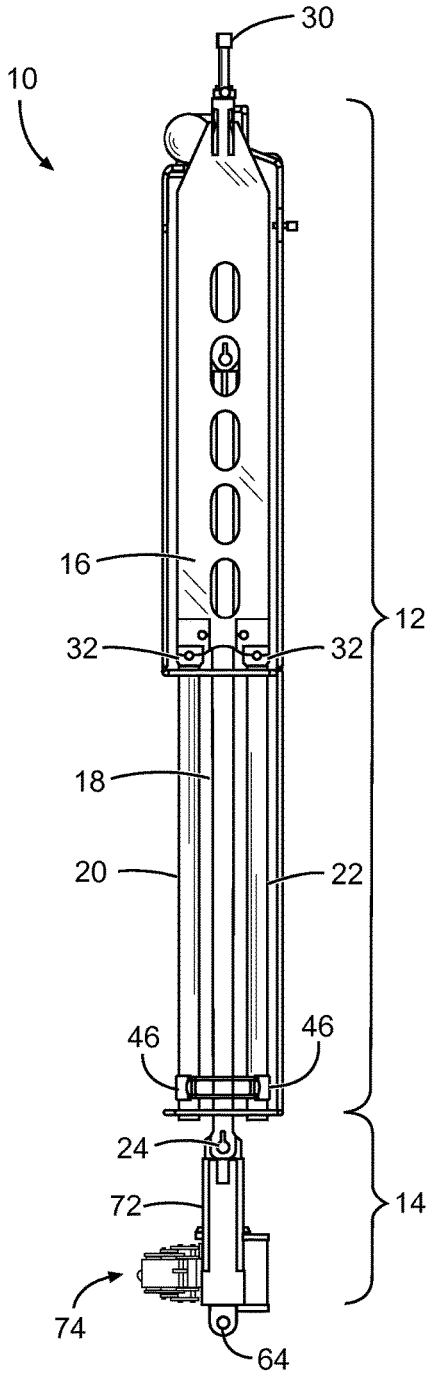
FIG. 3 is an elevation view of the left side of the lift frame of FIG. 1.

FIGS. 1-3 illustrate a motion-compensating well lift frame 10 according to an embodiment. Referring to FIGS. 1-3, lift frame 10 includes a frame 11, which may include upper section 12 and lower section 14. Upper section 12 may include outer frame 16 inner frame 18. Inner frame 18 may slide within outer frame 16 to provide vertical motion compensation, such as to account for heave in an offshore platform or vessel (not illustrated) on which lift frame 10 is carried. As illustrated, well lift frame 10 is in an extended state.

Outer frame 16 may include a central lift attachment point 30, which may be directly connected to an elevator of a drilling derrick or other rig (not illustrated) to suspend lift frame 10. Lower section 14 may be unitary, or it may formed of two individual sub-sections that when connected to upper section 12 are held in position relative to one another. Upper section 12 and lower section 14 may be pinned together via pins 24 to allow for articulation or separation of the sections for either the addition of leg extensions (not illustrated) or to assist in the installation of lift frame 10 into the elevator. Additionally, anti-rotation pins (not illustrated) may be provided to selectively prevent the articulation about pins 24 of lower section 14 relative to upper section 12.

Both outer and inner frames 16, 18 may be substantially U-shaped, or more particularly, inverted U-shaped. Upper section 12 may also include two pairs of compensating cylinders 20 and 22. Compensating cylinders 20, 22 may be connected between outer and inner frames 16, 18 and may provide force and control necessary for motion compensation of device 10. Outer frame 16 may include fixed trunnions 32 and inner frame 18 may include cylinder guide brackets 46 for attachment of compensating cylinders 20, 22. As described in greater detail below, lift frame 10 is arranged to carry strings and other equipment such as coiled tubing injector heads, blow-out preventer stacks, lubricators, and the like. Accordingly, to maintain such equipment at a fixed vertical position relative to the sea bed, compensating cylinders 20, 22 may be selectively activated. When the sea surface rises, compensating cylinders 20, 22 may be retracted to maintain the vertical position of the well intervention device, and when the sea surface falls, cylinders 20, 22 are extended to maintain vertical position. Compensating cylinders 20, 22 may be hydraulic or pneumatic, for example.

Lower section 14 is designed to support and carry strings or other equipment that extend to the sea bed. Lower section 14 may include structural attachment posts 64 where equipment may be carried via bails (not illustrated). Attachment posts 64 may be retractable into bushings 66 for facilitating installation of bails. Lift frame 10 may also include an overhead winch 62 to assist in positioning various equipment with respect to lower section 14. Winch 62 may be affixed to inner frame 18.

Although a particular motion-compensating lift frame 10 has been described hereinabove, other lift frame arrangements, both compensating and non-compensating, may also be used.

Lift frame 10 includes a vertical slot 70 having an opening 71 in the side of lift frame 10, into which a tubular or other equipment (FIG. 4) may be laterally positioned and carried by lift frame 10 in a manner similar to an elevator. A pivoting clamping assembly 74, described in greater detail hereinafter, may be mounted near vertical slot 70. Clamping assembly 74 allows such tubulars or equipment to be secured in place within vertical slot 70 yet allows for easy installation and removal thereof as necessary. In an embodiment, the front side 72 of lower section 14 includes or defines vertical slot 70, and clamping assembly 74 may be mounted to front side 72 of lower section 14.

Figure 4:
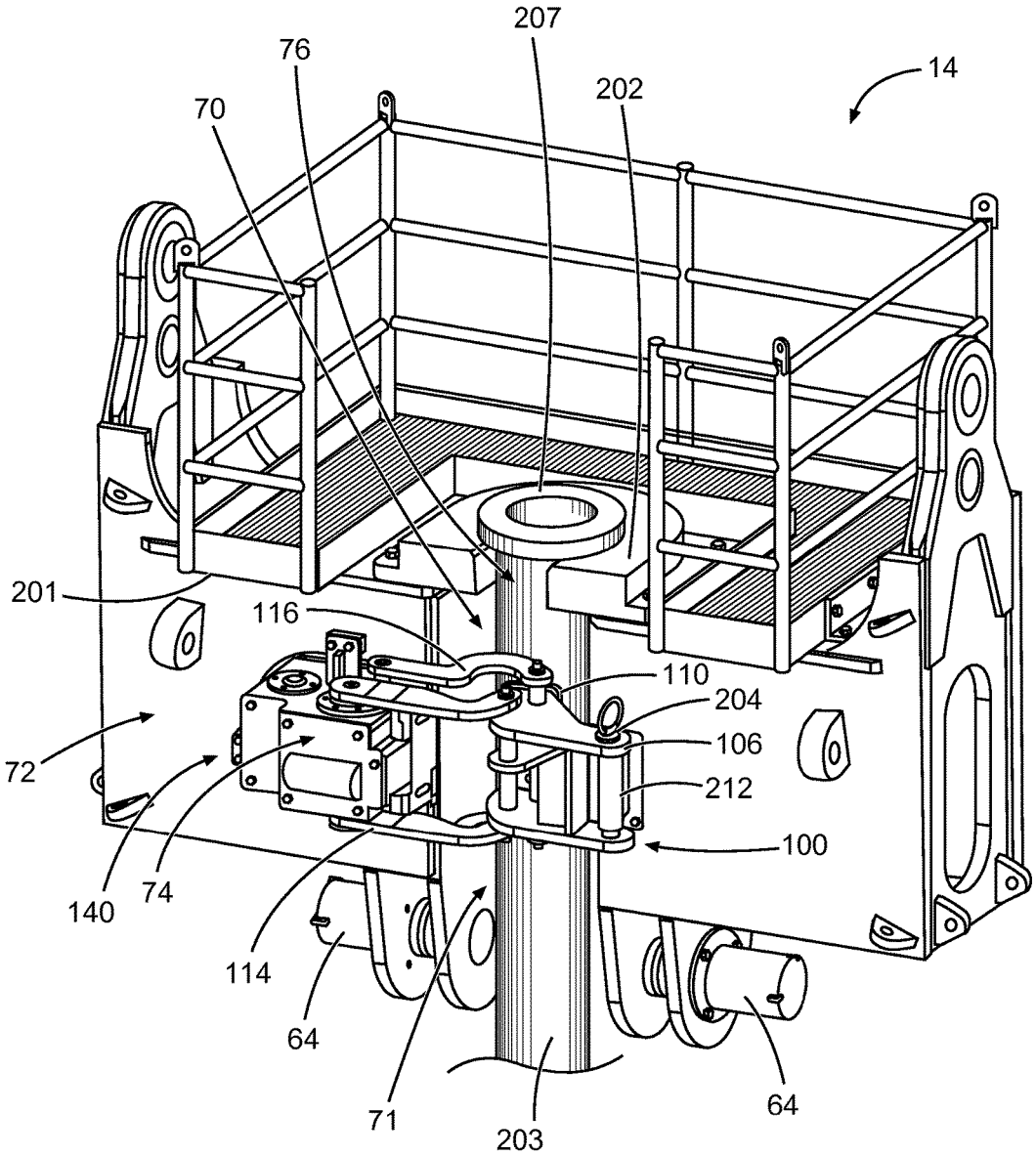
FIG. 4 is an enlarged perspective view of the lower section of the lift frame of FIG. 1.

FIG. 4 illustrates lower section 14 of lift frame 10 (FIGS. 1-3) according to an embodiment. Front side 72 of lower section 14 includes or defines vertical slot 70 with opening 71. Lower section 14 may include a hang-off plate 202 disposed at the top end of vertical slot 70, which has a slot 76 characterized by a smaller diameter than slot 70. In this manner, as illustrated, a string 203 (or other equipment), having a collar, box end, or the like 207 of a larger outer diameter than slot 76, may be suspended within slot 70 by hang-off plate 202. A catwalk 201 may be provided for safe operator access.

Clamping assembly 74 is mounted to lower section 14 to releasably secure string 203 within vertical slot 70, as described in greater detail below. A removable locking pin 204 may be provided to lock clamping assembly 74 into the position on the lower section 14.

Figure 5A:
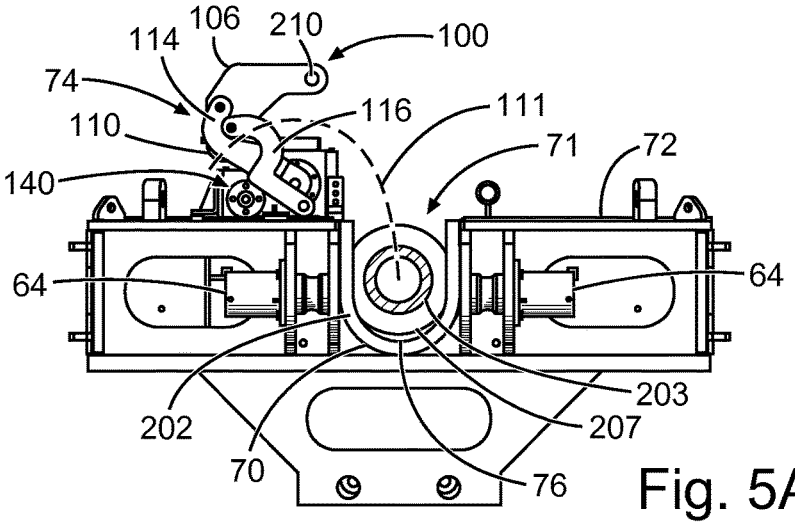
FIG. 5A is a plan view of bottom of the lift frame of FIG. 2, showing the clamping assembly in an open, disengaged position.
Figure 5B:
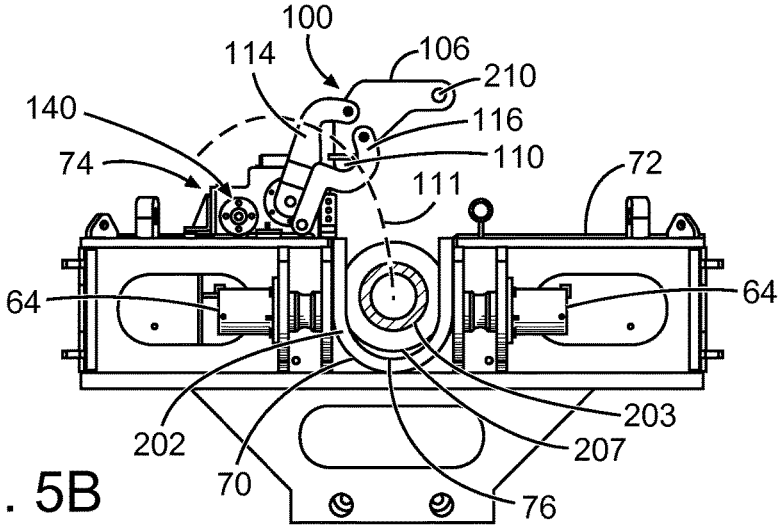
FIG. 5B is a plan view of bottom of the lift frame of FIG. 2, showing the clamping assembly undergoing a pivoting actuation process between disengaged and engaged position wherein a shoe of the clamping assembly is maintained parallel to the front side of the lift frame.
Figure 5C:
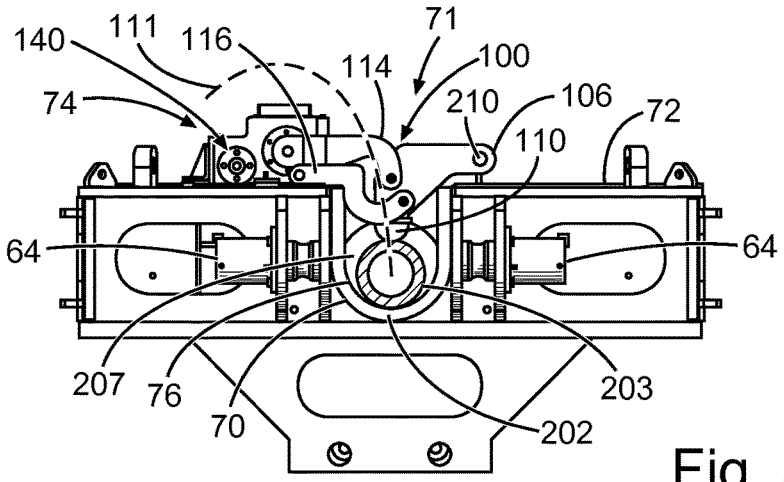
FIG. 5C is a plan view of bottom of the lift frame of FIG. 2, showing the clamping assembly in a closed, engaged position in contact with a string or other equipment suspended through the vertical slot of the lift frame.

Referring now to FIGS. 5A-5C, clamping assembly 74 includes a linkage assembly 100 that is selectively driven by an actuator 140. Linkage assembly 100 may carry a shoe 110 and is arranged to move along an arcuate path 111 between an open, disengaged position, in which linkage assembly 100 is substantially clear of opening 71 so that vertical slot 70 may be directly accessed via front side 72 for inserting or removing string 203 (FIG. 5A), and a closed, engaged position, in which linkage assembly 100 at least substantially covers the horizontal extent of opening 71, thereby preventing lateral removal of string 203 from vertical slot 70. In an embodiment, when in the engaged position, shoe 110 addresses and may securely clamp string 203 against the wall of slot 76 in hang-off plate 202 (FIG. 5C). In an embodiment, linkage assembly is arranged so that the face of shoe 110 remains parallel to front side 72 of lower section 14, thereby reducing the risk of clamp malfunction and delays in well operations. FIG. 5B illustrates clamping assembly 74 approximately midway between disengaged and engaged positions.

FIGS. 5A-5C further illustrate the fixed rotational positioning feature of linkage assembly 100 according to an embodiment. Each of the three figures show that as shoe 110 travels along arcuate path 111, it remains in the same orientation with respect to a front side 72 of lower section 14. This feature may be beneficial, because shoe 110 remains optimally aligned throughout the clamping actuation process so that the contact face 112 (FIG. 6) of shoe 110 properly engages string 203, ensuring clamping assembly 74 will function without failure or delay.

Figure 6:
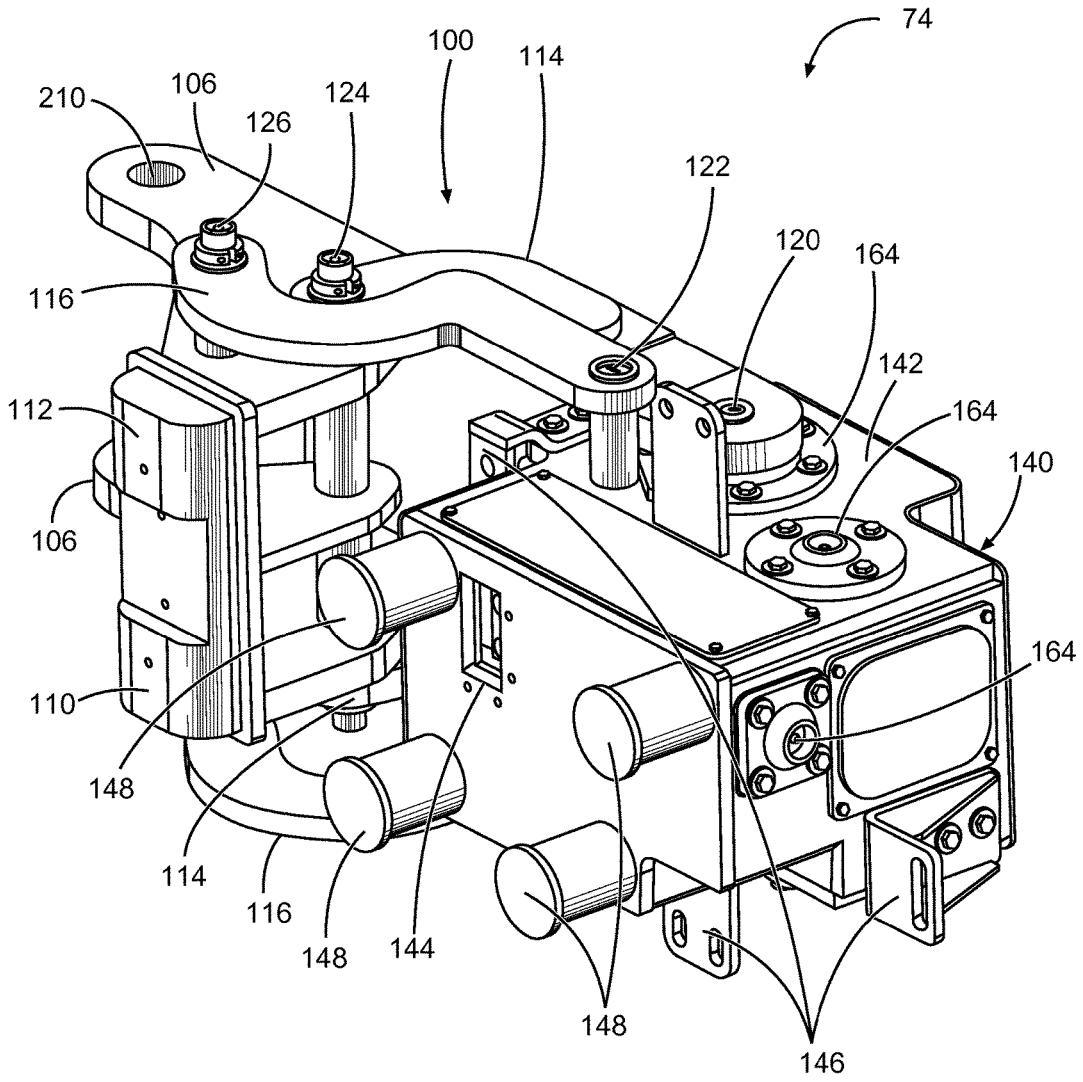
FIG. 6 is a perspective view of the back side of the clamping assembly of FIG. 4, showing a shoe for engaging a string or other equipment within the vertical slot of the lift frame, a linkage assembly and an actuator for positioning the shoe.
Figure 7:
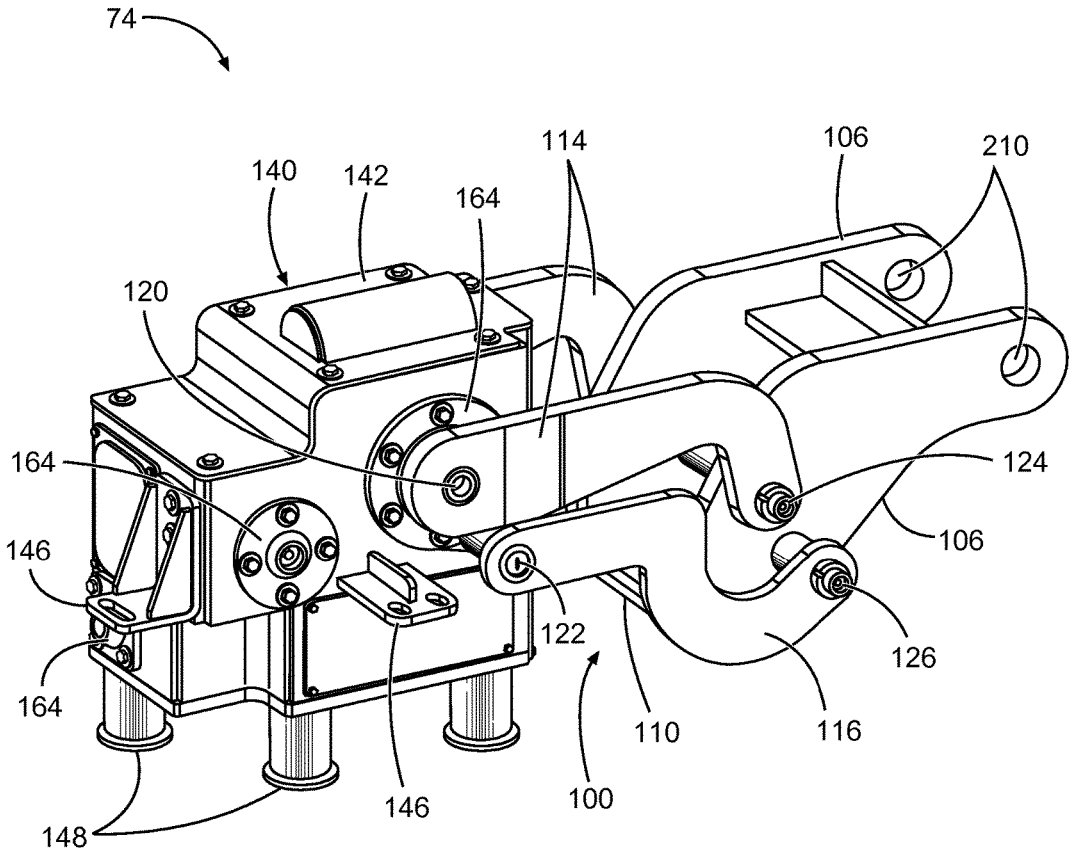
FIG. 7 is a perspective view of the bottom of the clamping assembly of FIG. 6.

FIG. 6 is a perspective view of the back side, i.e., the side that mounts to front side 72 of lower section 14, of clamping assembly 74 according to an embodiment, and FIG. 7 is a perspective view of the bottom of clamping assembly 74. Referring to FIGS. 4, 6, and 7, in a preferred embodiment, linkage assembly 100 defines a simple kinematic four-bar mechanism, in which each of four rigid links is pivotally connected to two other of the four links to form a closed polygon.

In a four-bar linkage mechanism, one link is typically fixed, with the result that a known position of only one other body is determinative of all other positions in the mechanism. The fixed link is also known as the ground link. The two links connected to the ground link are referred to as grounded links, and the remaining link not directly connected to the fixed ground link is referred to as the coupler link. Four-bar linkages are well known in mechanical engineering disciplines and are used to create a wide variety of motions with just a few simple parts.

A four-bar linkage mechanism is embodied in the design of linkage assembly 100 as follows: A fixed ground link is defined by a housing 142 of surrounding actuator 140 at driving point 120 and driven point 122. A first grounded link is defined by a driving master leg 114, which has a proximal, grounded end connected at driving point 120. Master leg 114 is rotated about driving point 120 by actuator 140, as described below. A second grounded link is defined by driven slave leg 116, which has a proximal, grounded end pivotally connected to housing 142 at driven point 122. A coupler link is defined by foot 106, which is pivotally connected to distal ends of master leg 114 and slave leg 116 at pivot points 124, 126, respectively. Foot 106 carries shoe 110. Housing 142, master leg 114, slave leg 116, and foot 106 may be pivotally interconnected at driven point 122 and pivot points 124, 126 using bushings, for example.

A functional feature of the four-bar linkage mechanism embodiment is that it causes shoe 110 to not rotate with respect to front side 72 of lower section 70 as it travels along arcuate path 111 (FIGS. 5A-5C) so that shoe 100 always properly engages the well operation equipment. The arcuate path 111 (FIGS. 5A-5C) traveled by shoe 110 between engaged and disengaged positions is determined by the physical characteristics of the four-bar mechanism, i.e., by the dimensions, shape and/or placement of housing 142, master leg 114, slave leg 116, foot 106, driving point 120, driven point 122, and pivot points 124, 126.

In an embodiment, master leg 114 and/or slave leg 116 may be sickle-shaped. A distal end of foot 106 may include an aperture 210 formed therethrough so that when clamping assembly 74 is in the engaged position, aperture 210 aligns with a tubular post 212 that is rigidly mounted to front side 72 of lower section 70 for locking clamping mechanism with locking pin 204. Aperture 110, tubular post 212, and locking pin 204 collectively form a locking assembly, although other locking assembly arrangements may be used as appropriate.

In an embodiment, as illustrated collectively in FIGS. 6 and 7, linkage assembly 100 includes upper and lower pairs of master legs 114, slave legs 116, and feet 106, which are disposed in parallel above and below actuator 140. Such an embodiment thereby defines upper and lower coaxial and parallel driving points 120, driven points 122, and pivot points 124, 126. Master legs 114, slave legs 116, and feet 106 may be connected at pivot point pairs 124, 126 using threaded rods or the like to provide additional rigidity to linkage assembly 100.

In addition to structurally forming the ground link of the four-bar linkage mechanism, housing 142 provides protection for internal components of actuator 140. Housing 142 may include at least one aperture 144 for actuator 140 to connect to a power source, which may be pneumatic, hydraulic, or electrical, for example. In embodiments where lift frame 10 includes compensating cylinders 20, 22 (FIG. 1) or another active heave compensation system, it may be advantageous to use the same type of power to actuator 140 as is used to power the heave compensating lift frame.

Still referring to FIGS. 4, 6 and 7, clamping assembly 74 may include a mount for installation to lower section 14 of the lift frame. The mount may include one or more brackets 146 for fastening actuator housing 142 to the lift frame. The mount may also include one or more cantilever beams 148 that protrude from housing 142 into mounting receptacles (not visible) within the lift frame.

Figure 8:
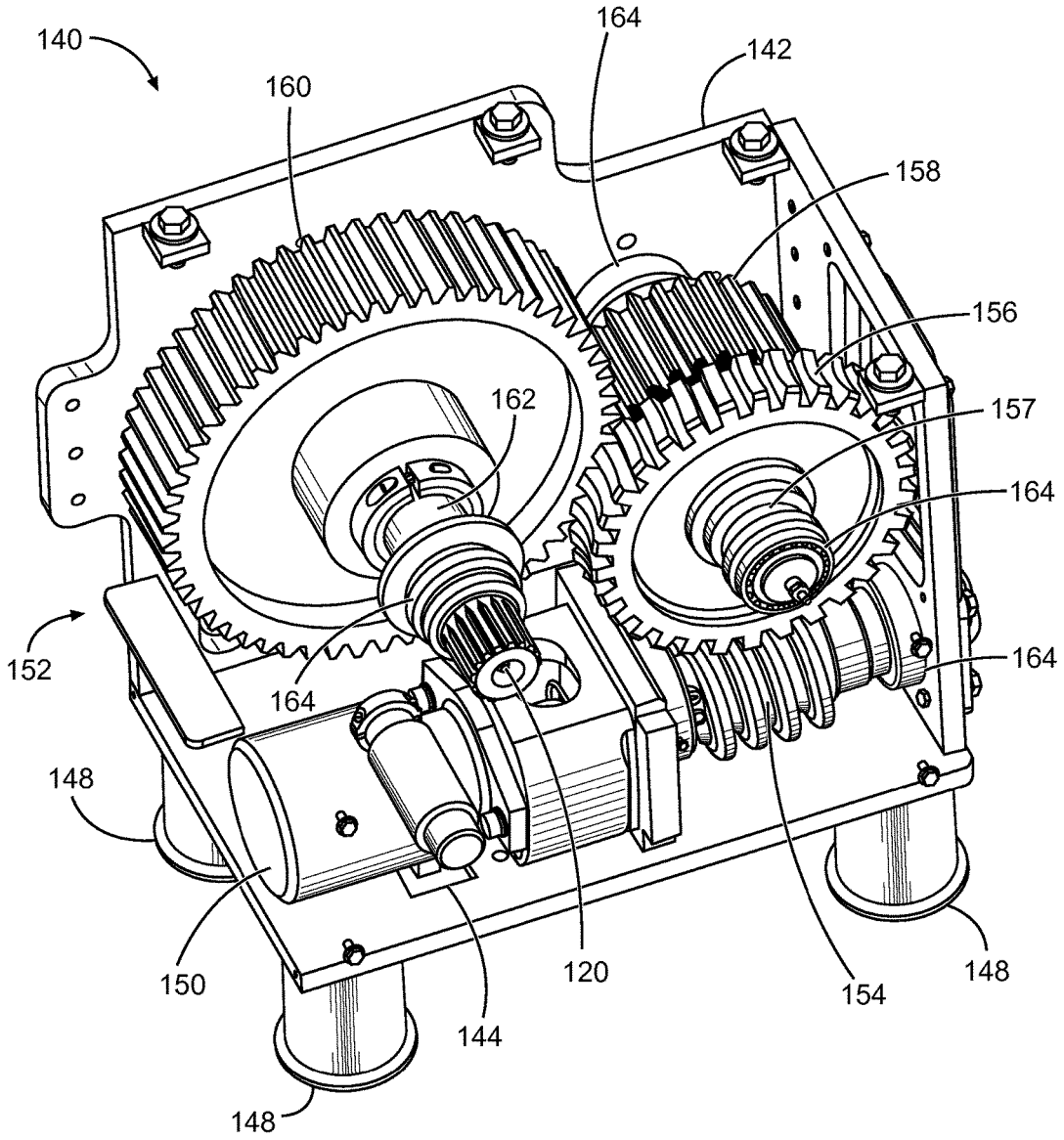
FIG. 8 is an enlarged perspective view of the actuator of FIG. 7 according to an embodiment, shown with the actuator cover removed to reveal internal components thereof.

FIG. 8 is an enlarged perspective view of actuator 140 according to an embodiment with a portion of cover 142 removed to reveal internal components thereof. Actuator 140 includes a prime mover 150 that selectively pivots master leg 114 (FIGS. 6 and 7) about driving point 120 via a transmission, which may include a double-reduction gear train assembly. Prime mover 150 may be a rotary motor, which may be hydraulically, pneumatically, or electrically powered, for example. Prime mover 150 may drive a worm gear assembly to provide a first stage speed reduction and force multiplication, which may in turn drive a set of spur gears to provide a second stage speed reduction and force multiplication. Use of a worm gear assembly may be advantageous, because it prevents forces imposed on shoe 110 by string 203 (FIGS. 4-7) from rotating gear train assembly 152.

Accordingly, in such an embodiment, prime mover 150 may be directly coupled to and drive a worm screw 154, which in turn may drive a worm wheel 156. Worm wheel 156 may be commonly coupled on a jack shaft 157 with a pinion 158, which in turn may mesh with and drive a bull gear 160. Bull gear 160 may be mounted on a splined shaft 162 that is coaxial with driving point 120 for pivoting master leg 114 (FIGS. 6 and 7).

Housing 142 carries prime mover 150 and bearing assemblies 164 for worm screw 154, jack shaft 157 (carrying worm wheel 156 and pinion 158), and bull gear 160. Housing 142 also protects prime mover 150 and gear train 152 from the elements and from damage. Although a particular arrangement for actuator 140 is described, any suitable prime mover, using any suitable transmission or power train as necessary, may be used as desired.

Figure 9:
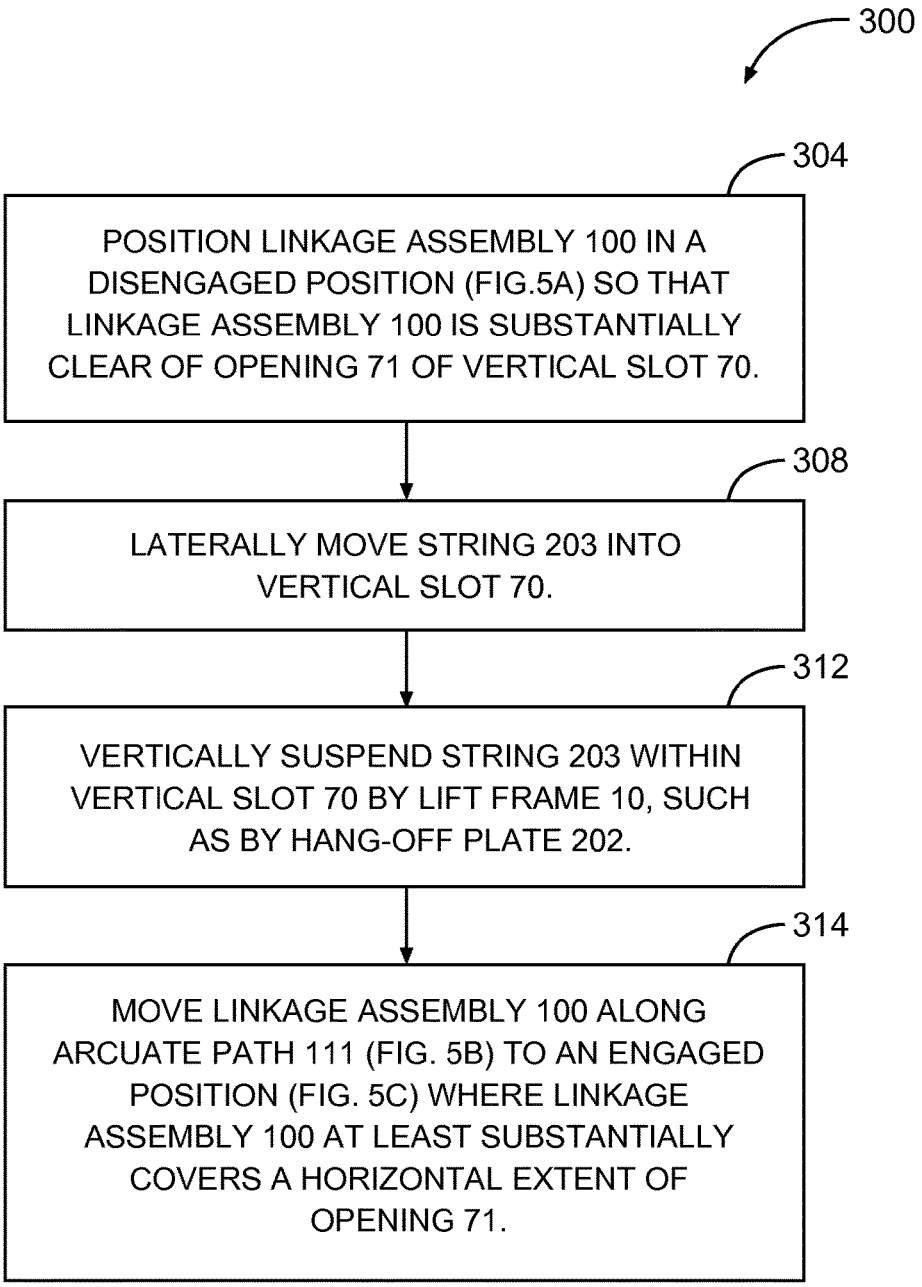
FIG. 9 is a flow chart of a method for suspending a string or other equipment from a lift frame according to an embodiment.

FIG. 9 is a flow chart outlining a method 300 for handling well equipment by a well lift frame. Referring to FIGS. 5A-5C and 9, method 300 outlines the steps for installing and clamping well equipment, such as string 203, within vertical slot 70 lift frame 10 (FIG. 1). To unclamp and remove string 203 from vertical slot 70, the steps are reverse. At step 304, linkage assembly 100 is positioned at the disengaged position (FIG. 5A) so as to be substantially clear of opening 71 of vertical slot 70. Thereafter, at step 308, string 203 may be laterally moved through opening 71 into vertical slot 70, and, at step 312, vertically suspended therein by supporting box end or coupling 207 of string 203 upon hang-off plate 202. However, other arrangements may be used to vertically support equipment by the lift frame within vertical slot 70, as appropriate. At step 314, linkage assembly 100 is moved along arcuate path 111 to an engaged position (FIG. 5C) that at least substantially covers a horizontal extent of opening 71, thereby preventing string 203 from inadvertently being laterally removed from vertical slot 70.

In summary, a clamping assembly, a well lift frame, and a method for handling equipment by a well lift frame have been described. Embodiments of the clamping assembly may have: A linkage assembly; and an actuator coupled to the linkage assembly so as to selectively position the linkage assembly; wherein the clamping assembly is arranged so that when mounted to a side of a well lift frame in proximity to a vertical slot having an opening formed in the side is operable to travel along an arcuate path between a disengaged position, in which the clamping assembly is substantially clear of the opening, and an engaged position in which the clamping assembly at least substantially covers a horizontal extent of the opening. Embodiments of the well lift frame may have: A frame; a vertical slot forming an opening in a side of the frame; and a clamping assembly mounted to the side of the frame in proximity to the opening, the clamping assembly including a linkage assembly arranged so as to travel along an arcuate path between a disengaged position, in which the clamping assembly is substantially clear of the opening, and an engaged position in which the clamping assembly at least substantially covers a horizontal extent of the opening, and an actuator coupled to the linkage assembly so as to selectively position the linkage assembly. Embodiments of the method for handling equipment by a well lift frame may generally include: Positioning a linkage assembly of a clamping assembly so as to be substantially clear of an opening of a vertical slot formed in the lift frame; laterally moving the equipment through the opening into the vertical slot; vertically suspending the equipment within the vertical slot by the lift frame; and then moving the linkage assembly along an arcuate path to an engaged position that at least substantially covers a horizontal extent of the opening.

Any of the foregoing embodiments may include any one of the following elements or characteristics, alone or in combination with each other: A shoe carried by the linkage assembly; the shoe defining a face; the linkage assembly is arranged to maintain the face of the shoe parallel to the side of the lift frame; the linkage assembly defines a four-bar linkage mechanism; a ground link fixed in relation to the lift frame; a master leg driven by the actuator; a slave leg pivotally coupled to the lift frame; a foot pivotally coupled to the master leg and the slave leg, the foot carrying the shoe; the ground link is defined by the actuator; a prime mover; a transmission operatively coupled between the prime mover and the master leg; the prime mover is a rotary motor; the transmission includes a gear train; a locking assembly disposed between the linkage assembly and the side of the lift frame and arranged for selectively locking the shoe in the engaged position; a locking assembly disposed between the linkage assembly and the side of the frame and arranged for selectively locking the clamping assembly in the engaged position; the frame includes an upper section translatably coupled to a lower section; the vertical slot is formed in the lower section; the clamping assembly mounted to a side of the lower section; the lift frame further comprises a compensating cylinder operatively coupled between the upper section and the lower section; carrying a shoe by the linkage assembly; contacting the equipment by the shoe when the linkage assembly is in the engaged position; carrying a shoe by the linkage assembly, the shoe having a face; maintaining an angular orientation of the face of the shoe with respect to the lift frame while moving the linkage assembly along the arcuate path; locking the clamping assembly in the engaged position to the lift frame; suspending an upper section of the lift frame by a rig; carrying a lower section of the lift frame by the upper section, the vertical slot formed in the lower section; and selectively moving the lower section with respect to the upper section to maintain a desired vertical position of the equipment with respect to a well.

The Abstract of the disclosure is solely for providing a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A clamping assembly, comprising:

a linkage assembly;

an actuator coupled to said linkage assembly so as to selectively position said linkage assembly; and a shoe carried by said linkage assembly, said shoe defining a face;

wherein said clamping assembly is arranged so that when mounted to a side of a well lift frame in proximity to a vertical slot having an opening formed in said side, said clamping assembly is operable to travel along an arcuate path between a disengaged position, in which said clamping assembly is substantially clear of said opening, and an engaged position in which said clamping assembly at least substantially covers a horizontal extent of said opening;

wherein said linkage assembly is arranged to maintain said face of said shoe parallel said side of said well lift frame while said clamping assembly travels along said arcuate path.

2. The clamping assembly of claim 1, wherein:

said linkage assembly defines a four-bar linkage mechanism.

3. The clamping assembly of claim 2 wherein said linkage assembly further comprises:

a ground link fixed in relation to said lift frame;

a master leg driven by said actuator;

a slave leg pivotally coupled to said lift frame; and a foot pivotally coupled to said master leg and said slave leg, said foot carrying said shoe.

4. The clamping assembly of claim 3 wherein:

said ground link is defined by said actuator.

5. The clamping assembly of claim 4 wherein said actuator further comprises:

a prime mover; and a transmission operatively coupled between said prime mover and said master leg.

6. The clamping assembly of claim 5 wherein:

said prime mover includes a rotary motor; and said transmission includes a gear train.

7. The clamping assembly of claim 5 further comprising:

a locking assembly disposed between said linkage assembly and said side of said lift frame and arranged for selectively locking said shoe in said engaged position.

8. A well lift frame comprising: a frame;

a vertical slot forming an opening in a side of said frame; and a clamping assembly mounted to said side of said frame in proximity to said opening, said clamping assembly including a linkage assembly arranged so as to travel along an arcuate path between a disengaged position, in which said clamping assembly is substantially clear of said opening, and an engaged position in which said clamping assembly at least substantially covers a horizontal extent of said opening, and an actuator coupled to said linkage assembly so as to selectively position said linkage assembly; wherein said linkage assembly comprises:

a ground link fixed in relation to said lift frame, said ground link defined by said actuator;

a master leg driven by said actuator; a slave leg pivotally coupled to said lift frame; and a foot directly pivotally coupled to said master leg and said slave leg, said foot carrying a shoe.

9. The lift frame of claim 8 further comprising:

said shoe carried by said linkage assembly, said shoe defining a face; wherein said linkage assembly is arranged to maintain said face of said shoe parallel to said side of said lift frame.

10. The lift frame of claim 9 wherein said actuator further comprises:

a prime mover; and a transmission operatively coupled between said prime mover and said master leg.

11. The lift frame of claim 8 further comprising:

a locking assembly disposed between said linkage assembly and said side of said frame and arranged for selectively locking said clamping assembly in said engaged position.

12. The lift frame of claim 8 wherein:

said frame includes an upper section translatably coupled to a lower section;

said vertical slot is formed in said lower section;

said clamping assembly mounted to a side of said lower section; and said lift frame further comprises a compensating cylinder operatively coupled between said upper section and said lower section.

13. A clamping assembly on a well lift frame, comprising:

a linkage assembly comprising:

a ground link fixed in relation to said lift frame; a master leg driven by an actuator; a slave leg pivotally coupled to said lift frame; and a foot directly pivotally coupled to said master leg and said slave leg, said foot carrying a shoe; and the actuator coupled to said linkage assembly so as to selectively position said linkage assembly;

wherein said clamping assembly is arranged so that when mounted to a side of the well lift frame in proximity to a vertical slot having an opening formed in said side, said clamping assembly is operable to travel along an arcuate path between a disengaged position, in which said clamping assembly is substantially clear of said opening, and an engaged position in which said clamping assembly at least substantially covers a horizontal extent of said opening.

14. The clamping assembly of claim 13 further comprising:

said shoe carried by said linkage assembly, said shoe defining a face; wherein said linkage assembly is arranged to maintain said face of said shoe parallel to said side of said lift frame.

15. The clamping assembly of claim 14 wherein:

said ground link is defined by said actuator.

16. The clamping assembly of claim 15 wherein said actuator further comprises:

a prime mover; and a transmission operatively coupled between said prime mover and said master leg.

17. The clamping assembly of claim 16 wherein:

said prime mover includes a rotary motor; and said transmission includes a gear train.

18. The clamping assembly of claim 17 further comprising:

a locking assembly disposed between said linkage assembly and said side of said lift frame and arranged for selectively locking said shoe in said engaged position.

* * * * *